US007264447B2

(12) United States Patent
Ono et al.

(10) Patent No.: US 7,264,447 B2
(45) Date of Patent: Sep. 4, 2007

(54) SEALING ARRANGEMENT FOR AN AXIAL TURBINE WHEEL

(75) Inventors: Takashi Ono, Wako (JP); Hakaru Takamatsu, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 402 days.

(21) Appl. No.: 10/949,395

(22) Filed: Sep. 27, 2004

(65) Prior Publication Data

US 2005/0123405 A1 Jun. 9, 2005

(30) Foreign Application Priority Data

Dec. 5, 2003 (JP) ..... 2003-406691

(51) Int. Cl.
*F01D 1/02* (2006.01)

(52) U.S. Cl. ..... 416/193 A; 416/219 R; 416/220 R; 416/221

(58) Field of Classification Search ..... 416/193 A, 416/219 R, 220 R, 221
See application file for complete search history.

(56) References Cited

U.S. PATENT DOCUMENTS 3,137,478 A * 6/1964 Farrell ..... 416/220 R
3,501,249 A * 3/1970 Scalzo et al. ..... 416/95
3,853,425 A * 12/1974 Scalzo et al. ..... 416/95
4,021,138 A * 5/1977 Scalzo et al. ..... 416/95
4,523,890 A * 6/1985 Thompson ..... 416/95
5,954,477 A * 9/1999 Balsdon ..... 416/95

FOREIGN PATENT DOCUMENTS

JP 11-247616 9/1999

* cited by examiner

*Primary Examiner*—Hoang Nguyen
(74) *Attorney, Agent, or Firm*—Squire, Sanders & Dempsey L.L.P.

(57) ABSTRACT

In an axial turbine wheel including a rotor disk and a plurality of turbine blades each having a base end retained by the rotor disk via a joint and extending radially from the rotor disk, a seal plate is received in outer and annular slots formed in the base ends of the turbine blades and rotor disk, respectively, and an annular shoulder is formed in the wall defining the inner annular slot on a side remote from the rotor disk, the annular shoulder thereby defining an inner narrow section and an outer wide section in the inner annular slot. Thus, the seal plate can be easily placed in position by first fitting the inner peripheral edge thereof in the inner narrow section of the inner annular slot, fitting the outer peripheral edge thereof in the outer annular slot until the inner peripheral edge clears the annular shoulder. Thereby, the outer and inner peripheral edges of the seal plate are received in the outer annular slot and outer wide section of the inner annular slot. The outer peripheral edge of the seal plate may abut the bottom of the outer annular slot so as to allow the seal plate to be firmly retained even when subjected to a large centrifugal force.

6 Claims, 3 Drawing Sheets

SEALING ARRANGEMENT FOR AN AXIAL TURBINE WHEEL

TECHNICAL FIELD

The present invention relates to a sealing arrangement for an axial turbine wheel including a rotor disk and a plurality of turbine blades extending radially from the rotor disk and each having a base end retained by the rotor disk via a joint such as a Christmas tree joint and a dove-tail joint.

BACKGROUND OF THE INVENTION

In an axial turbine wheel of a gas turbine engine, each turbine blade is attached to the rotor disk typically by means of an engagement between a Christmas tree section or a dove-tail section provide at the base end of the turbine blade and a corresponding recess formed in the rotor disk. Such an engagement structure provides a favorable radial retaining force, but requires a means for retaining each turbine blade against axial movement. Additionally, it is necessary to provide a sealing arrangement for the gaps of the Christmas tree or dove-tail sections as the leakage of primary and secondary air from the gaps causes a significant reduction in efficiency.

Seal plates of various forms that provide both the axial retaining force and sealing capability have been proposed, and Japanese patent laid open publication No. 11-247616 discloses such seal plates. According to this prior proposal, after turbine blades are installed except for a few of them, seal plates are inserted in a circumferential slot defined between the rotor disk and turbine blades from the gap created by the absence of turbine blades. Thereafter, the remaining turbine blades are installed, and a special seal plate adapted to be installed from the axial direction is placed in the position corresponding to the finally installed turbine blades.

However, according to this proposal, when one of the turbine blades is required to be replaced, the special seal plate that can be removed in the axial direction is first removed, and the remaining seal plates are circumferentially shifted one after another until the base end of the turbine blade that is required to be replaced is revealed. Therefore, a plurality of seal plates are generally required to be moved about even when only a single turbine blade is required to be replaced. Therefore, the maintenance and service work for the axial turbine is not so simple as desired.

BRIEF SUMMARY OF THE INVENTION

In view of such problems of the prior art, a primary object of the present invention is to provide a sealing arrangement for an axial turbine wheel which is easy to service and maintain.

A second object of the present invention is to provide such a sealing arrangement for an axial turbine wheel which is simple in structure and reliable in operation.

These and other objects of the present invention can be accomplished by providing a sealing arrangement for an axial turbine wheel including a rotor disk and a plurality of turbine blades each having a base end retained by the rotor disk via a joint and extending radially from the rotor disk, comprising: an outer annular slot formed in base portions of the turbine blades so as to face radially inward in a coaxial relationship outwardly of the joints; an inner annular slot formed in the rotor disk so as to face radially outward in a coaxial relationship inwardly of the joints; an annular shoulder provided in a wall defining the inner annular slot on a side remote from the rotor disk, the annular shoulder thereby defining an inner narrow section and an outer wide section in the inner annular slot; and a fan-shaped seal plate made of resilient material and defined by an arcuate outer peripheral edge received in the outer annular slot and an arcuate inner peripheral edge received in the outer wide section of the inner annular slot, the outer and inner peripheral edges being disposed in a coaxial relationship; wherein the depth of the outer annular slot is equal to or greater than the depth of the inner narrow section of the inner annular slot, and the radial dimension of the seal plate is substantially equal to the distance between a bottom of the outer annular slot and the annular shoulder.

Alternatively, the outer annular slot may be represented as being defined by an outer annular wall extending radially inwardly from the base end of each turbine blade in cooperation with an axial end surface of the base end of the turbine blade in a coaxial relationship outwardly of the joints, and the inner annular slot as being defined by an inner annular wall extending radially outwardly from the rotor disk in cooperation with an axial end surface of the rotor disk in a coaxial relationship inwardly of the joints.

Thus, the seal plate can be easily placed in position by first fitting the inner peripheral edge thereof in the inner narrow section of the inner annular slot, fitting the outer peripheral edge thereof in the outer annular slot until the inner peripheral edge clears the annular shoulder. Thereby, the outer and inner peripheral edges of the seal plate are received in the outer annular slot and outer wide section of the inner annular slot. The outer peripheral edge of the seal plate may abut the bottom of the outer annular slot so as to allow the seal plate to be firmly retained even when subjected to a large centrifugal force.

The seal plate may be curved in such a manner that a convex side of a middle part thereof abuts the base portion of a corresponding turbine blade and the outer and inner peripheral edges thereof abut the walls of the outer annular slot and the inner narrow section of the inner annular slot, respectively, remote from the rotor disk. Thereby, a convex surface of the radially middle part of the seal plate engages the base end of the turbine blade that forms a part of the joint while the inner and outer edges of the seal plate are engaged by the annular slots, respectively, so that the seal plate provides the function to retain the rotor blade against axial movement.

For the convenience of applying a tool when installing and removing the seal plate, the seal plate may be provided with at least one projection projecting away from the rotor disk.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
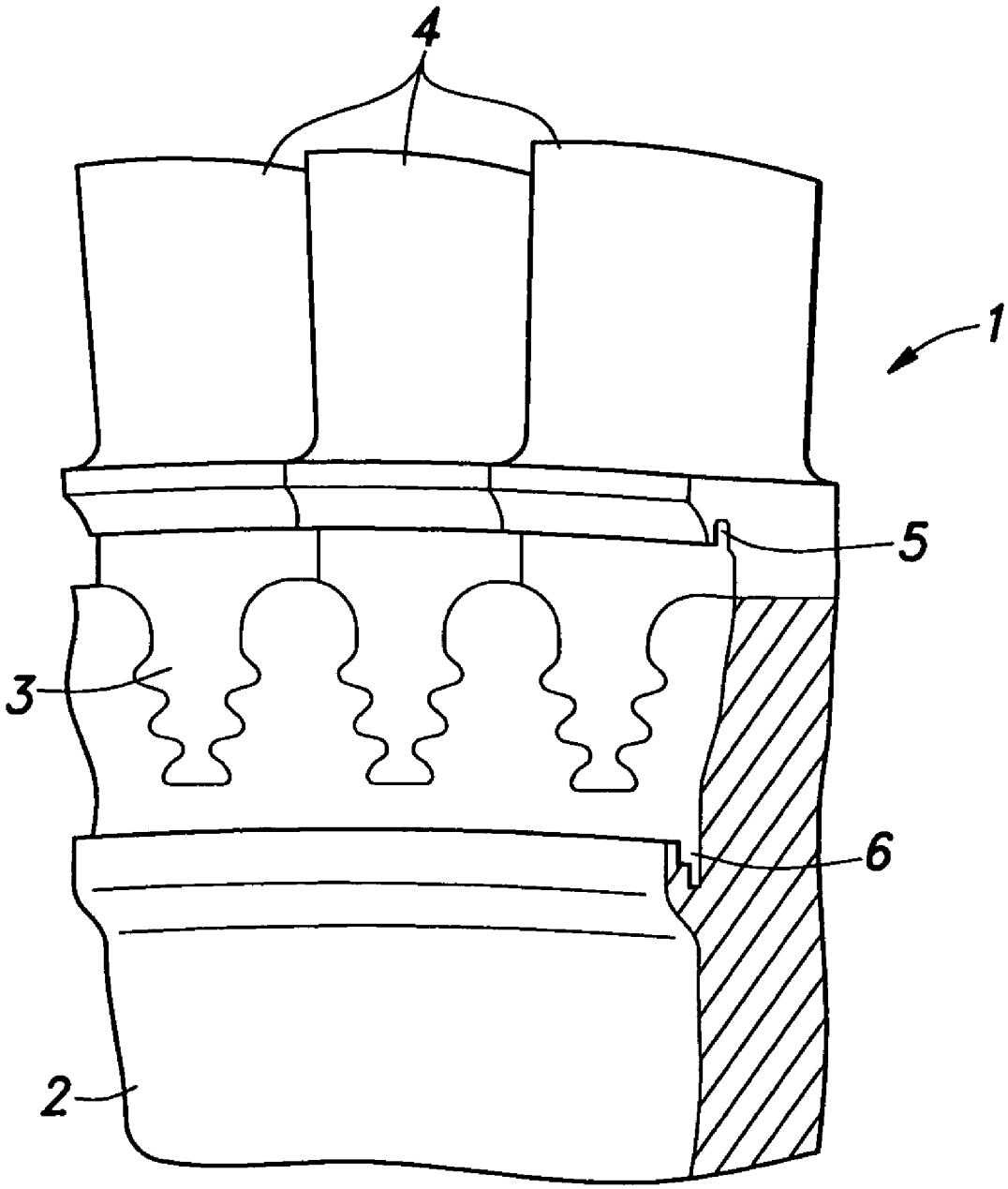
FIG. 1 is a fragmentary perspective view of a turbine wheel embodying the present invention.

FIG. 1 shows a part of a turbine wheel assembly embodying the present invention. The turbine wheel assembly 1 comprises a rotor disk 1 and a plurality of turbine blades 4 each attached to the rotor disk 2 at a base end thereof via a Christmas tree joint 3 and extending radially from the outer circumferential surface of the rotor disk 1.

The rotor disk 2 is provided with an inner annular slot 6 which is coaxial with the rotor disk 2 and faces a radially outward direction, somewhat inward of the inner ends of the Christmas tree joints 3. An outer annular slot 5 facing radially inward in a coaxial relationship is formed in the base ends of the turbine blades 4, somewhat outward of the outer ends of the Christmas tree joints 3. These two annular slots 5 and 6 therefore oppose each other in a coaxial relationship.

Figure 2:
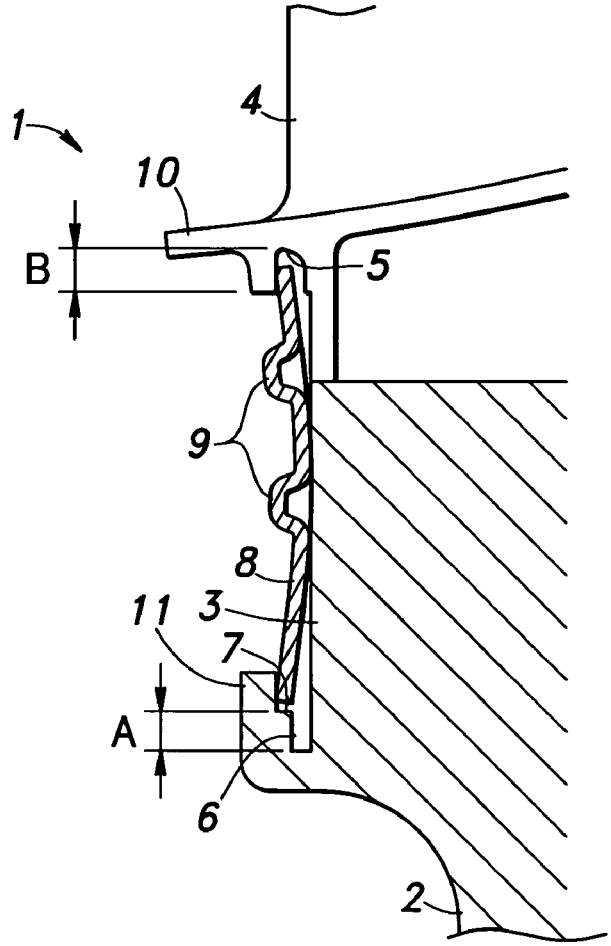
FIG. 2 is a fragmentary longitudinal sectional view of the turbine wheel.

As shown in FIG. 2, the outer annular slot 5 formed in the turbine blades 4 is somewhat flared toward the axial center, and has a radial depth B when seen in the longitudinal section passing through the axial center. Therefore, the outer annular slot 5 may be represented as being defined by an outer annular wall 10 extending radially inwardly from the base end of each turbine blade 4 in cooperation with an axial end surface of the base end of the turbine blade 4 in a coaxial relationship outwardly of the joints 3. The inner annular slot 6 may also be represented as being defined by an inner annular wall 11 extending radially outwardly from the rotor disk 2 in cooperation with an axial end surface of the rotor disk 2 in a coaxial relationship inwardly of the joints 3. The inner annular slot 6 formed in the rotor disk 2 is provided with a stepped width. More specifically, when seen in the longitudinal section passing through the axial center, the inner annular slot 6 includes a narrower inner section and a wider outer section that are defined by an annular shoulder 7. The narrower inner section of the inner annular slot 6 has a radial depth A. The depth A is equal to or greater than the depth B ($A \geqq B$).

Figure 3:
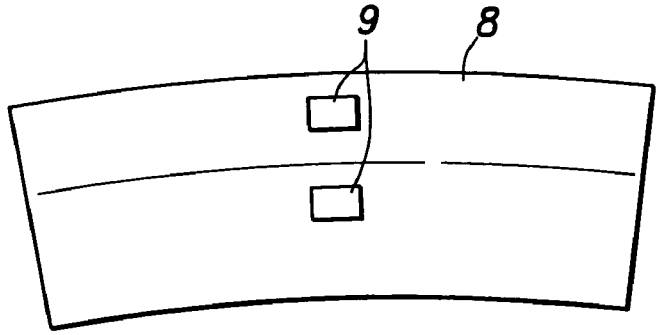
FIG. 3 is a plan view of the seal plate.

Referring to FIG. 3, each seal plate 8 that is to be received in these slots 5 and 6 is fan-shaped which is defined by coaxial arcuate edges on the outer and inner periphery thereof and has a circumferential length to cover three Christmas tree joints 3, for example. The radial length of the seal plate 8 is determined such that when the seal plate 8 is inserted in the inner annular slot 6 until the inner edge of the seal plate 8 hits the bottom of the inner annular slot 6, the outer edge of the seal plate 8 can clear the free end of the outer annular wall 10 in the base end of the turbine blade 4 that defines the outer annular slot 5.

The seal plate 8 is made of steel plate capable of withstanding the high temperature to which the seal plate 8 is exposed in operation, and is somewhat curved so as to present a convex surface toward the rotor disk 1 as seen in the longitudinal section passing through the axial center. A pair of projections 9 are provided in radially intermediate parts of the seal plate 8 by stamp forming for the convenience of applying a tool when inserting and removing the seal plate 8.

Figure 4C:
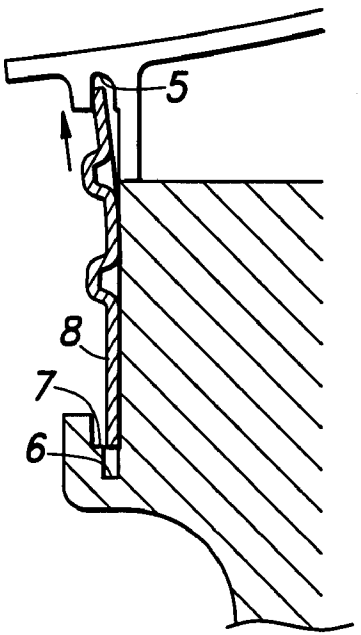
FIGS. 4*a* to 4*c* are longitudinal sectional views showing the mode of installing the seal plate.
Figure 4B:
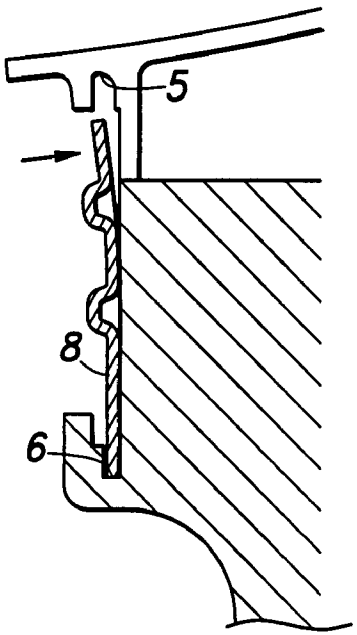
Figure 4A:
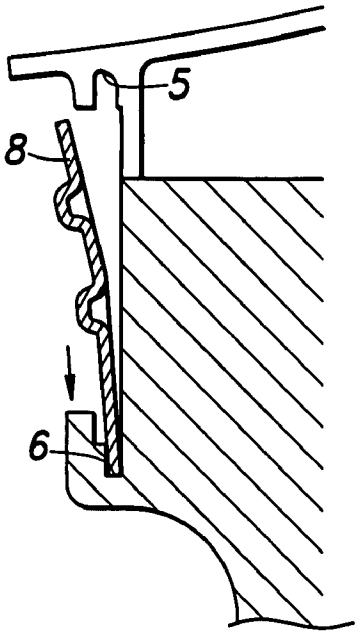

How this seal plate 8 can be installed in the annular slots 5 and 6 is described in the following with reference to FIGS. 4*a* to 4*c*.

First of all, all of the turbine blades 4 are installed in the rotor disk 2. The inner edge of each seal plate 8 is inserted in the inner annular slot 6 with the convex surface of the seal plate 8 facing the rotor disk 2 until its inner edge reaches the bottom of the inner annular slot 6. Thereafter, the outer edge of the seal plate 8 is pushed toward the rotor disk 2 until it clears the free end of the outer annular wall 10 that defines the outer annular slot 5. This can be accomplished by using a suitable lever tool. The seal plate 8 is then pushed radially outward by using a tool for engaging one or both of the projections 9 until the inner edge of the seal plate clears the annular shoulder 7 formed in the inner annular wall 11 defining the inner annular slot 6. The radial dimension of the seal plate 8 is determined such that the outer edge of the seal plate 8 substantially abuts the bottom of the outer annular slot 5. At this time, because of the resiliency of the material of the seal plate 8, the inner edge of the seal plate 8 snaps back, and rests against a part of the inner annular wall that defines the wide section of the inner annular slot 6.

Because the resilient force of the seal plate 8 still persists in this condition, the seal plate 8 remains firmly lodged in the annular slots 5 and 6. Furthermore, in operation, a centrifugal force acts upon the seal plate 8, and the seal plate 8 is thereby urged toward the bottom of the outer annular slot 5. Therefore, the seal plate 8 is firmly held in position both in rest condition and in operation. As best illustrated in FIG. 2, a convex surface of the radially middle part of the seal plate 8 engages the base end of the turbine blade 4 that forms a part of the Christmas tree joint 3 while the inner and outer edges of the seal plate 8 are engaged by the annular walls 10 and 11 so that the seal plate 8 provides the function to retain the rotor blade 4 against axial movement. The circumferential length of the seal plate is determined in such a manner that the adjoining seal plates 8 abut each other substantially without any gap between them while permitting the necessary radial movement of the seal plates 8.

The seal plate 8 may be removed by following the foregoing procedure in a reverse order. The radial position of the seal plate 8 differs depending on whether the seal plate 8 is placed in the final position or in the process of being installed. The two projections 9 of the seal plate 8 are located at two different radial positions so as to allow the tool to engage either one of the two projections depending on the radial position of the seal plate 8.

As can be appreciated from the foregoing description of the preferred embodiment of the present invention, it is possible to install and remove any one of the seal plates while keeping all the turbine blades in position. Therefore, when any one of the turbine blades is required to be replaced, it can be accomplished simply by removing only a corresponding one of the seal plates. Therefore, the servicing and maintenance work for the turbine wheel can be simplified.

Although the present invention has been described in terms of a preferred embodiment thereof, it is obvious to a person skilled in the art that various alterations and modifications are possible without departing from the scope of the present invention which is set forth in the appended claims.

The invention claimed is:

1. A sealing arrangement for an axial turbine wheel including a rotor disk and a plurality of turbine blades each having a base end retained by the rotor disk via a joint and extending radially from the rotor disk, comprising:

an outer annular slot formed in base portions of the turbine blades so as to face radially inward in a coaxial relationship outwardly of the joints;

an inner annular slot formed in the rotor disk so as to face radially outward in a coaxial relationship inwardly of the joints;

an annular shoulder provided in a wall defining the inner annular slot on a side remote from the rotor disk, the annular shoulder thereby defining an inner narrow section and an outer wide section in the inner annular slot; and a fan-shaped seal plate made of resilient material and defined by an arcuate outer peripheral edge received in the outer annular slot and an arcuate inner peripheral edge received in the outer wide section of the inner annular slot, the outer and inner peripheral edges being disposed in a coaxial relationship;

wherein the depth of the outer annular slot is equal to or greater than the depth of the inner narrow section of the inner annular slot, and the radial dimension of the seal plate is substantially equal to the distance between a bottom of the outer annular slot and the annular shoulder.

2. A sealing arrangement for an axial turbine wheel according to claim 1, wherein the seal plate is curved in such a manner that a convex side of a middle part thereof abuts the base portion of a corresponding turbine blade and the outer and inner peripheral edges thereof abut the walls of the outer annular slot and the inner narrow section of the inner annular slot, respectively, remote from the rotor disk.

3. A sealing arrangement for an axial turbine wheel according to claim 1, wherein the seal plate is provided with at least one projection projecting away from the rotor disk.

4. A sealing arrangement for an axial turbine wheel including a rotor disk and a plurality of turbine blades each having a base end retained by the rotor disk via a joint and extending radially from the rotor disk, comprising:

an outer annular wall extending radially inwardly from the base end of each turbine blade so as to define an outer annular slot in cooperation with an axial end surface of the base end of the turbine blade in a coaxial relationship outwardly of the joints;

an inner annular wall extending radially outwardly from the rotor disk so as to define an inner annular slot in cooperation with an axial end surface of the rotor disk in a coaxial relationship inwardly of the joints;

an annular shoulder provided in the inner annular wall so as to define an inner narrow section and an outer wide section in the inner annular slot; and a fan-shaped seal plate made of resilient material and defined by an arcuate outer peripheral edge received in the outer annular slot and an arcuate inner peripheral edge received in the outer wide section of the inner annular slot, the outer and inner peripheral edges being disposed in a coaxial relationship;

wherein the depth of the outer annular slot is equal to or greater than the depth of the inner narrow section of the inner annular slot, and the radial dimension of the seal plate is substantially equal to the distance between a bottom of the outer annular slot and the annular shoulder.

5. A sealing arrangement for an axial turbine wheel according to claim 4, wherein the seal plate is curved in such a manner that a convex side of a middle part thereof abuts the base portion of a corresponding turbine blade and the outer and inner peripheral edges thereof abut the inner and outer annular walls, respectively.

6. A sealing arrangement for an axial turbine wheel according to claim 4, wherein the seal plate is provided with at least one projection projecting away from the rotor disk.

* * * * *